United States Patent [19]

Oetker

[11] Patent Number: 4,541,213

[45] Date of Patent: Sep. 17, 1985

[54] SHUTTERING ELEMENTS

[76] Inventor: Max Oetker, Burgkoppel 30a, 2400 Lübeck, Fed. Rep. of Germany

[21] Appl. No.: 452,765

[22] Filed: Dec. 23, 1982

[30] Foreign Application Priority Data

Dec. 24, 1981 [DE] Fed. Rep. of Germany ..... 3151397

[51] Int. Cl.[4] ..... E04B 2/38; E04C 1/10

[52] U.S. Cl. ..... 52/309.17; 52/437; 52/562

[58] Field of Search ..... 52/562–572, 52/425, 426, 427, 438, 309.12, 309.17, 439

[56] References Cited

U.S. PATENT DOCUMENTS

| | | | |
|---|---|---|---|
| 1,188,604 | 6/1916 | Anderson | 52/563 |
| 1,763,916 | 6/1930 | Anderson | 52/570 |
| 1,887,432 | 11/1932 | Reeder et al. | 52/565 |
| 2,061,822 | 11/1936 | Bankert | 52/562 |
| 3,410,044 | 11/1968 | Moog | 52/309.12 |
| 3,581,454 | 6/1971 | Fitzek | 52/438 |
| 4,229,920 | 10/1980 | Lount | 52/426 |

FOREIGN PATENT DOCUMENTS 1,784,573 1/1973 Fed. Rep. of Germany .

*Primary Examiner*—James L. Ridgill, Jr.

*Attorney, Agent, or Firm*—Kinzer, Plyer, Dorn & McEachran; Kinzer, Plyer, Dorn & McEachran

[57] ABSTRACT

This invention relates to shuttering or sheathing elements of hard expanded plastics material for construction of buildings by the concrete casing method, of the kind comprising two mutually parallel panels or slabs having a tongued and grooved form at their edges and webs interconnecting the panels. According to the invention the panel forming the outer casing is considerably thicker than the panel of the element forming the inner casing.

2 Claims, 3 Drawing Figures

FIG. 1
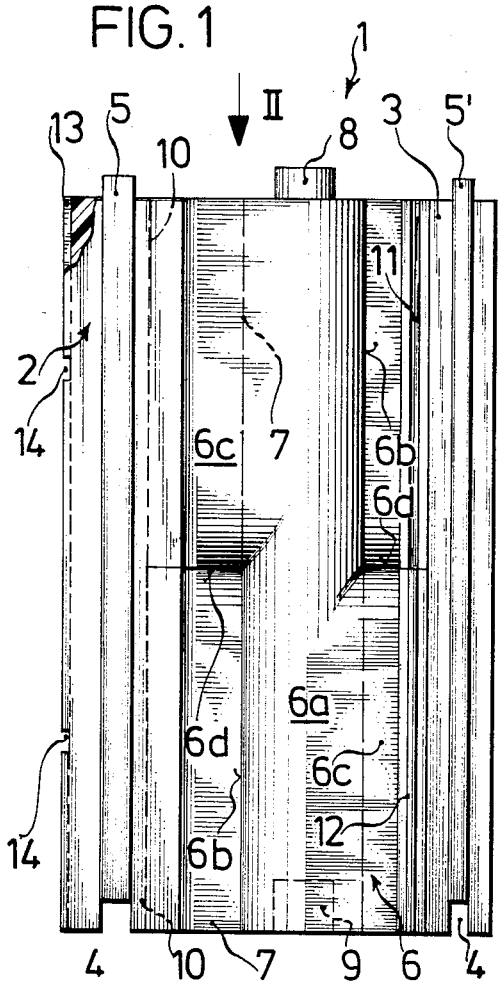
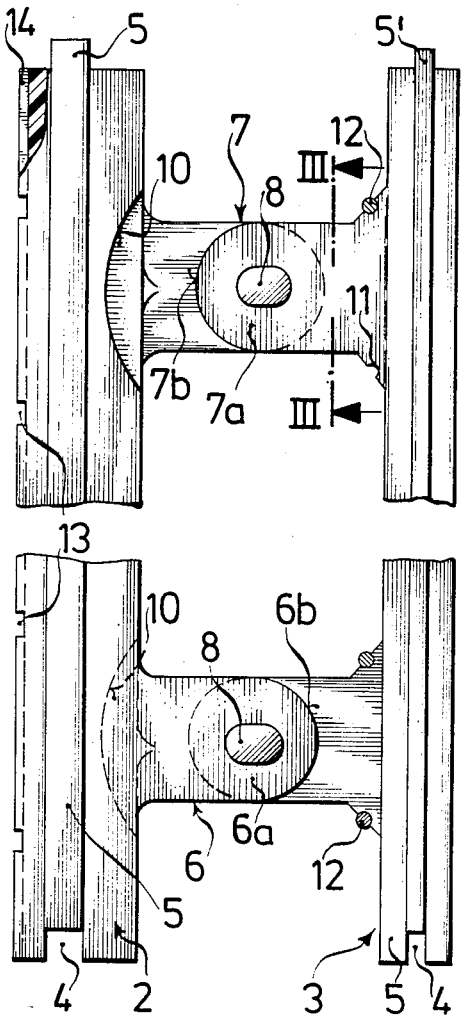
FIG. 2
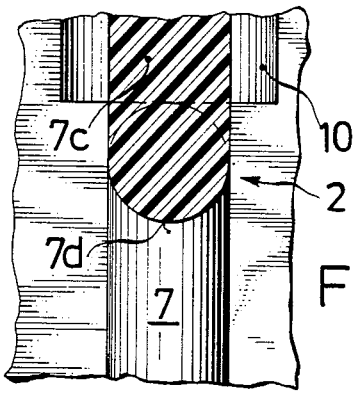
FIG. 3

SHUTTERING ELEMENTS

BACKGROUND OF THE INVENTION

The present invention relates to a shuttering or sheathing element of hard expanded plastics material for the concrete casing method of construction, comprising two panels arranged parallel to each other and having a tongue and groove structure at their edges, and webs interconnecting the panels.

A shuttering element corresponding to the kind referred to above is disclosed in the German Patent Specification No. 1,784,573. The two panels forming the corresponding subsequent insulating jackets are identical in thickness in the case of this element. This results in the disadvantage that, since the thickness of the panels is comparatively great to secure a very satisfactory heat barrier, the period of vapour traversal through the cavity-side panel forming the inner jacket is of considerable length. The humidity exchange between the wall of the structure and the internal space is thereby completed in comparatively sluggish manner, which has an unfavourable effect on the interior environment. It has been observed moreover that the possibility of anchoring fastening means, e.g. dowels, needs improving so that even heavy objects may be fastened to the walls by means of simple dowels.

It is an object of the invention to provide an improved shuttering element of the kind referred to above, so that, whilst assuring an excellent heat barrier, a comparatively rapid vapour permeability at the interior side, a more satisfactory exploitation of the poured concrete as a heat store, as well as secure anchoring of fastening means, are accomplished.

SUMMARY OF THE INVENTION

To achieve this and other objects, the invention consists in a shuttering or sheathing element of hard expanded plastics material for the concrete casing method of construction, comprising two panels arranged mutually parallel with a tongued and grooved structure at their edges and webs connecting the panels, wherein the panel forming the outer casing is thicker than the panel forming the inner casing.

Under retention of very satisfactory heat barrier action, the thinner panel subsequently situated at the inner side simultaneously improves vapour permeability from the inner side, so that humidity may penetrate comparatively rapidly from the interior volume into the concrete core present in the shuttering elements asssembled and filled with concrete, so that the feature of the interior environment depending on humidity is rapidly controlled. On the other hand, the concrete core may also be exploited more satisfactorily as a heat store, since it is reached more rapidly by the heat of the room, and conversely can return comparatively more stored heat into the room. Because of the comparatively thin panel forming the inner jacket or the inner side of the room, longer fastening means being dowels in particular, penetrate to an adequate depth into the concrete and provide a better hold thereby, so that even heavy objects may be fastened to a wall of this nature.

The element may include Z-shaped webs, in which case the portions of the thicker panel at least which lie opposite to the central part of the webs may be recessed. Also, the connecting elements of the webs may terminate flush with the panel edge and the extremity of the central web sections, and the inner horizontal portion of the connecting elements may have a curved outline shape.

A structural shuttering or sheathing element of this kind has an increased breaking strain, that is, where rammed concrete or plastic concrete is used. In the first case, shrinkage points or cavities are no longer produced during ramming directly below the downwardly directed horizontal surfaces of the connecting elements of the webs, since the ramming tool may conveniently reach these points or reliably carry concrete in the direction towards these points. A separation can no longer occur at these points even upon pouring plastic concrete, since proportions of coarser grit or gravel of the concrete can also reach these points. Furthermore, an increase in strength is also obtained by the fact that more concrete may be introduced into at least some of the gaps between the panel and web, so that a thicker concrete web is formed.

BRIEF DESCRIPTION OF THE DRAWINGS

In order that the invention may be more clearly understood, reference will now be made to the accompanying drawings which show one embodiment thereof by way of example and in which:

FIG. 1 shows an end view of the element,

FIG. 2 shows a plan view corresponding to the arrow II of FIG. 1, and

FIG. 3 shows a partial cross-sectional illustration along the line III—III of FIG. 2.

DETAILED DESCRIPTION OF THE PREFERRED EMBODIMENT

Referring now to the drawings, according to FIGS. 1 and 2, the shuttering or sheathing element 1 which is for use in the construction of buildings by the concrete casing construction method, comprises two mutually parallel plastics material panels or slabs 2 and 3 of hard expanded plastics material, e.g. styrofoam. At their edges or narrow sides, the panels are provided with a configuration consisting of a groove 4 and tongue 5, in conventional manner. The panel forming the outer casing is of thicker construction than the other and is utilised to form an external jacket having a powerful heat barrier action, for the outer walls of the building. In the example, the panel 2 is considerably thicker than the other panel 3, e.g. three times as thick. As a rule, the thickness of the outer panel 2 will be of the order magnitude of 4 cms to 20 cms and will preferably amount to say 12 cms; the thickness of the inner pannel or slab 3 will be of the order of magnitude of 2 cms to 8 cms and will preferably amount to say 5 cms.

Furthermore, the tongued and grooved configuration 4, 5 of the thicker panel 2 is also made wider as compared to that of the thinner panel 3. This greater size of the one tongued and grooved structure contributes to firmer cohesion between the assembled shuttering elements under appropriately close tolerances, and is moreover less liable to incur breakage during transportation and handling of the elements.

The panels 2, 3 are preferably interconnected by Z-shaped webs 6 and 7. The central part **6*a*, 7*a* of the webs extends at both extremities up to the edges or narrow sides of the panels 2, 3 and may be provided at one end of the element with a stud 8 and at the other end with a corresponding recess 9. Moreover, the areas 6*b* and 7*b* of the webs directly opposed to the panels are preferably made in rounded or polygonal form or are formed in curved manner in another way (FIG 2). The connecting elements 6c and 7c, respectively of the webs 6 and 7 extend over say half the height of the pannels 2, 3 and at their one end terminate in flush and equiplanar manner with the panel edge and the end of the central part 6a, 7a of the web. On the other hand, their inner horizontal section 6d and 7d, respectively, is rounded in outline or made curved in another manner, as clearly apparent from FIG. 3**.

At least the thicker panel 2 of the element 1 has recesses 10 placed opposite to the sections 6b and 7b of the webs 6 and 7 and allow of thicker concrete coupling webs being formed subsequently in the gaps delimited thereby.

The webs 6, 7 may comprise means for fixing conventional reinforcing fittings. As apparent from FIG. 2, sections 11 which receive or fix reinforcing fittings 12 may be integrated in the areas of transition from the connecting elements 6c, 7c to the thinner panel 3.

As apparent from FIGS. 1 and 2 and especially from FIG. 2, the Z-shaped webs 6, 7 of the element 1 are turned 180° with respect to each other to point in opposite directions and establish mirror symmetry. The subsequent result is a meandering path of the concrete poured in, which in particular signifies an increase of the morphological strength of the cured concrete.

In an advantageous development, one feature consists in that preferably the thicker panel 2 forming the outer casing is provided with vertical grooves 13. These grooves assure improved adhesion of a plaster facing (not shown) on the external surface of the panel 2. Alternately, or complementarily, horizontal grooves 14 may also be incorporated. The grooves have a width of, say, 2–3 mms. and a depth of 2 mms.

The shuttering or sheathing element described is advantageously made in modular sizes in length, e.g. in the sizes 12.5 cms, 25 cms, 50 cms and 100 cms. The height may for example amount to 33.3 cms and the width to 36 cms, for example.

I claim:

1. A shuttering or sheathing building construction element of rigid expanded plastics material for the concrete casing method of construction, comprising two panels arranged mutually parallel with a tongued and grooved structure at their edges and webs connecting the panels, wherein the thickness of the panel forming the outer casing is of the order or magnitude of 4 to 20 cms, the panel forming the inner casing is appreciably thinner and of the order or magnitude of 2 to 8 cms, the thinner panel thus affording more permeability to humidity and quicker heat exchange as well compared to the outer panel, and wherein the panel forming the outer casing has a wider tongued and grooved pattern than the other, thinner, panel, said webs being Z-shaped webs joining the panels, the central section of the Z-webs being extended up to the height of the panel edges and the Z-webs having curved marginal areas which areas lie parallel to and face toward the opposite casing panel, wherein the areas of at least the panel forming the outer casing which lie opposite to said curved marginal areas of the Z-webs are recessed, the connecting elements of the Z-webs terminating flush with the plate edge and the extremity of the connecting elements being of curved outline shape, and wherein, as seen in plan view, two adjacent Z-webs are turned through 180° with respect to each other in each element.

2. A shuttering or sheathing building construction element of rigid expanded plastics material for the concrete casing method of construction, comprising two panels arranged mutually parallel with a tongued and grooved structure at their edges and webs connecting the panels, wherein the thickness of the panel forming the outer casing is greater than the panel forming the inner casing, the thinner panel thus affording more permeability to humidity and quicker heat exchange as well compared to the outer panel, said webs being Z-shaped webs joining the panels, the central section of the Z-webs being extended up to the height of the panel edges and the Z-webs having curved marginal areas which areas lie parallel to and face toward the opposite casing panel, wherein the areas of at least the panel forming the outer casing which lie opposite to said curved marginal areas of the Z-webs are recessed, the connecting elements of the Z-webs terminating flush with the plate edge and the extremity of the central web sections, and the inner horizontal portion of the connecting elements being of curved outline shape, and wherein, as seen in plan view, two adjacent Z-webs are turned through 180° with respect to each other in each element.

* * * * *